US007850464B2

(12) United States Patent
Lee et al.

(10) Patent No.: US 7,850,464 B2
(45) Date of Patent: Dec. 14, 2010

(54) KEYBOARD CONNECTING MECHANISM CAPABLE OF ASSEMBLING A KEYBOARD CONVENIENTLY

(75) Inventors: Chia-Ching Lee, Taipei Hsien (TW); Liang Yu, Taipei Hsien (TW); Cheng-Hsiang Chuang, Taipei Hsien (TW)

(73) Assignee: Wistron Corporation, Hsi-Chih, Taipei Hsien (TW)

( * ) Notice: Subject to any disclaimer, the term of this patent is extended or adjusted under 35 U.S.C. 154(b) by 150 days.

(21) Appl. No.: 12/409,511

(22) Filed: Mar. 24, 2009

(65) Prior Publication Data

US 2010/0035442 A1 Feb. 11, 2010

(30) Foreign Application Priority Data

Aug. 7, 2008 (TW) ..... 97214149 U

(51) Int. Cl.
*H01R 12/00* (2006.01)

(52) U.S. Cl. ..... 439/77

(58) Field of Classification Search ..... 439/43, 439/61, 65, 67, 59, 493, 40, 55, 77
See application file for complete search history.

(56) References Cited

U.S. PATENT DOCUMENTS

| | | | | |
|---|---|---|---|---|
| 3,499,515 | A * | 3/1970 | Mikrut | 400/477 |
| 7,740,486 | B2 * | 6/2010 | Watanabe | 439/55 |
| 2005/0037643 | A1 * | 2/2005 | Lo | 439/77 |
| 2006/0258179 | A1 * | 11/2006 | Watanabe | 439/55 |
| 2010/0203747 | A1 * | 8/2010 | Hu et al. | 439/77 |

* cited by examiner

*Primary Examiner*—Edwin A. Leon
(74) *Attorney, Agent, or Firm*—Winston Hsu; Scott Margo

(57) ABSTRACT

A keyboard connecting mechanism includes a frame, a cable, and a socket. The frame is connected to a keyboard. At least one first positioning structure is disposed on the frame. The cable is disposed on a side of the frame. The cable includes a plurality of pins, and at least one hole is formed on the cable. The socket includes a base. At least one second positioning structure is formed on a first side of the base for connecting with the first positioning structure so as to fix the frame and the cable. The socket further includes a plurality of fragments disposed on the first side of the base for applying elastic force to the plurality of pins of the cable. The socket further includes at least one elastic structure disposed on a lateral side of the base for fixing the frame elastically.

22 Claims, 4 Drawing Sheets

KEYBOARD CONNECTING MECHANISM CAPABLE OF ASSEMBLING A KEYBOARD CONVENIENTLY

BACKGROUND OF THE INVENTION

1. Field of the Invention

The present invention relates to a keyboard connecting mechanism, and more particularly, to a keyboard connecting mechanism capable of assembling a keyboard easily and conveniently.

2. Description of the Prior Art

In general, assembling a keyboard always takes much time when fabricating a notebook computer. In the conventional procedure of assembling the keyboard is as follows: lifting the keyboard to keep a distance with a host, inserting a membrane cable of the keyboard into a connector on the host, covering the connector, and aiming hooks on the keyboard at corresponding slots on the host for locking the keyboard on the host. However, it increases difficulty in assembly due to aligning the membrane cable with the connector and aligning the hooks with the slots. There is a need to design a keyboard connecting mechanism capable of assembling a keyboard easily and conveniently.

SUMMARY OF THE INVENTION

According to the claimed invention, a keyboard connecting mechanism includes a frame connected to a keyboard. At least one first positioning structure is disposed on the frame. The keyboard connecting mechanism further includes a cable electrically connected to the keyboard and disposed on a side of the frame. The cable includes a plurality of pins, and at least one hole is formed on the cable and disposed on a position corresponding to the first positioning structure. The keyboard connecting mechanism further includes a socket including a base where at least one second positioning structure is formed on a first side of the base and disposed on a position corresponding to the hole on the cable for connecting with the first positioning structure so as to fix the frame and the cable, a plurality of fragments disposed on the first side of the base for applying elastic force to the plurality of pins, and at least one elastic structure disposed on a lateral side of the base for fixing the frame elastically.

According to the claimed invention, a portable computer includes a housing, a keyboard installed on the housing, and a frame connected to the keyboard. At least one first positioning structure is disposed on the frame. The portable computer further includes a cable electrically connected to the keyboard and disposed on a side of the frame. The cable includes a plurality of pins, and at least one hole is formed on the cable and disposed on a position corresponding to the first positioning structure. The portable computer further includes a socket installed inside housing. The socket includes a base where at least one second positioning structure is formed on a first side of the base and disposed on a position corresponding to the hole on the cable for connecting with the first positioning structure so as to fix the frame and the cable, a plurality of fragments disposed on the first side of the base for applying elastic force to the plurality of pins, and at least one elastic structure disposed on a lateral side of the base for fixing the frame elastically.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
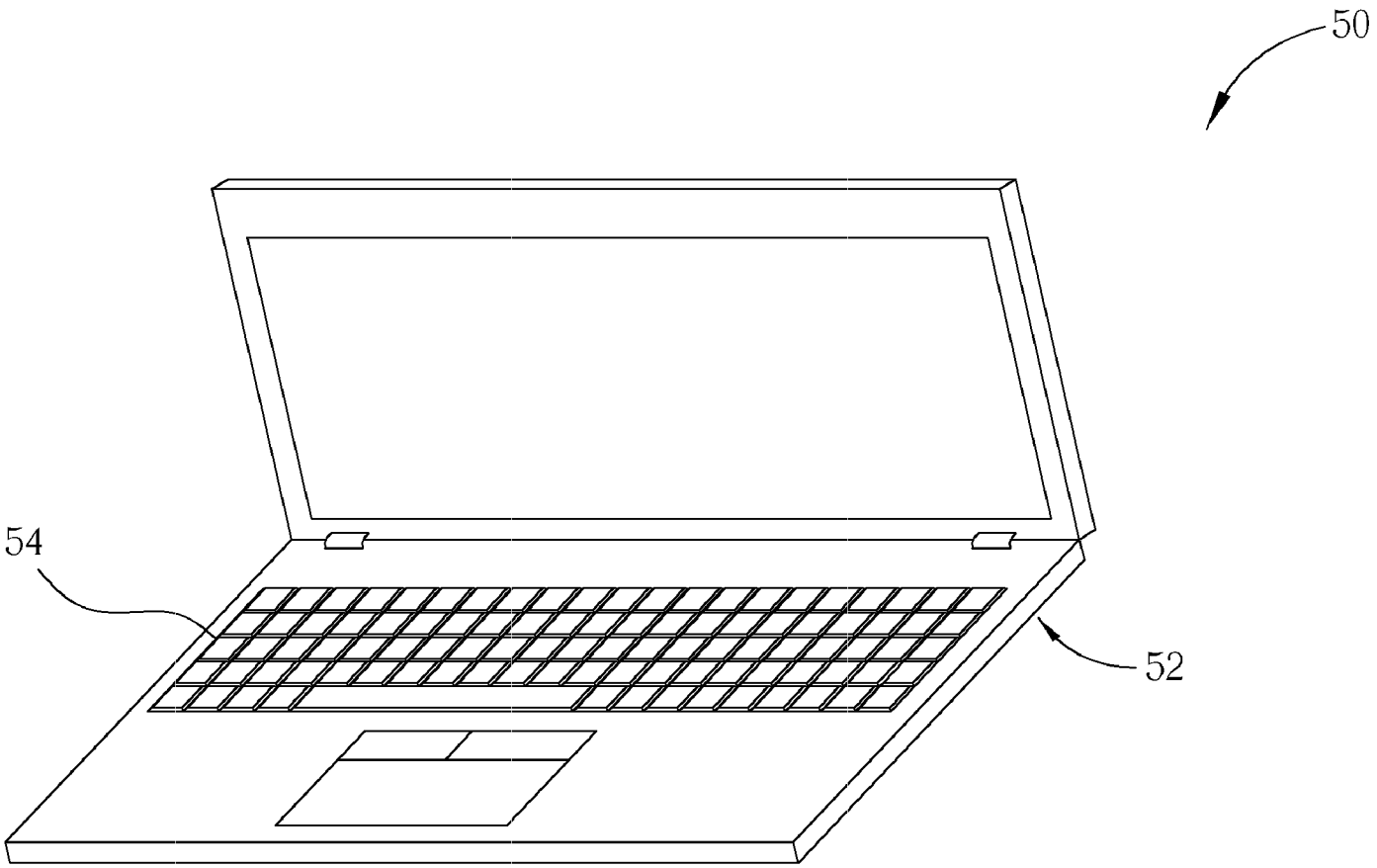
FIG. 1 is a diagram of a portable computer according to a preferred embodiment of the present invention.
Figure 2:
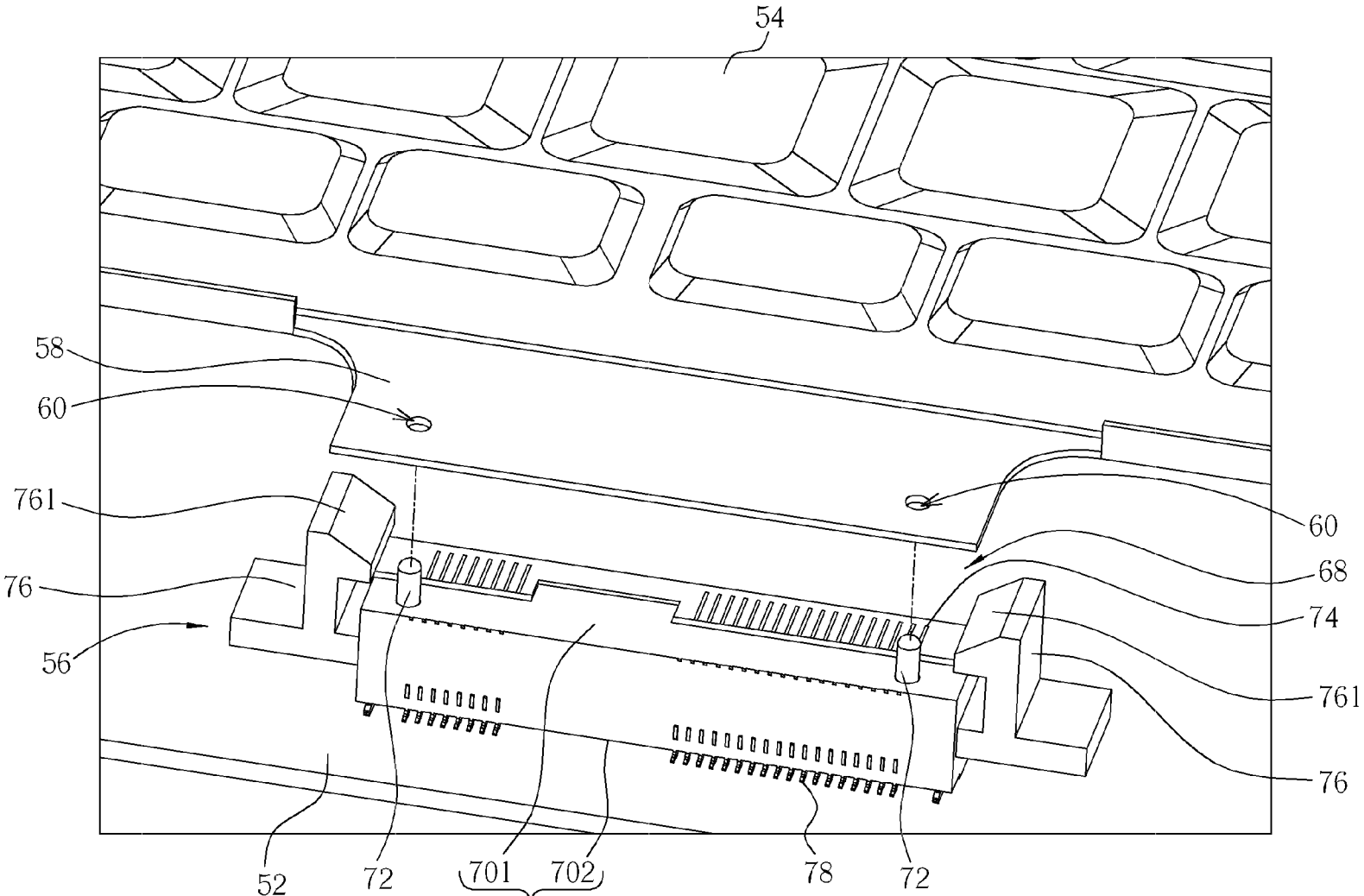
FIG. 2 is an exploded diagram of a keyboard connecting mechanism according to the preferred embodiment of the present invention.
Figure 3:
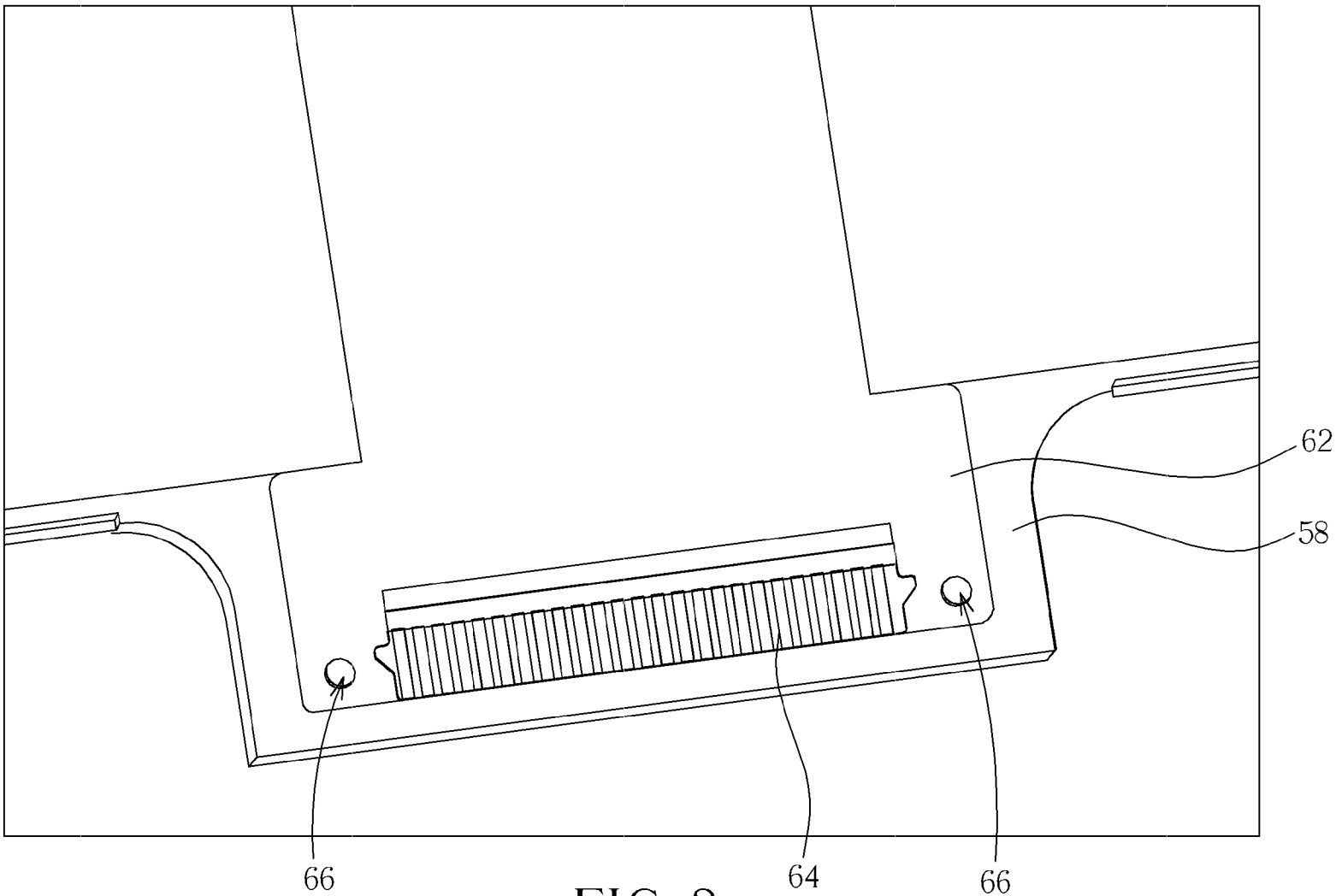
FIG. 3 is a bottom view of a frame according to the preferred embodiment of the present invention.

Please refer to FIG. 1. FIG. 1 is a diagram of a portable computer 50 according to a preferred embodiment of the present invention. The portable computer 50 includes a housing 52, and a keyboard 54 installed on the housing 52. Please refer to FIG. 2. FIG. 2 is an exploded diagram of a keyboard connecting mechanism 56 according to the preferred embodiment of the present invention. The keyboard connecting mechanism 56 includes a frame 58 connected to the keyboard 54. The frame 58 can be a metal plate, such as an iron plate. The frame 58 and the keyboard 54 can be integrated monolithically. At least one first positioning structure 60 is disposed on the frame 58. In this embodiment, there are two first positioning structure 60 disposed on both sides of the frame 58 respectively, and the first positioning structure 60 is a hole. Please refer to FIG. 3. FIG. 3 is a bottom view of the frame 58 according to the preferred embodiment of the present invention. The keyboard connecting mechanism 56 includes a cable 62 electrically connected to the keyboard 54 and disposed on a bottom side of the frame 58. The cable 62 can be a membrane cable, such as a flexible printed circuit. The cable 62 includes a plurality of pins 64, and two holes 66 are formed on the cable 62 and disposed on positions corresponding to the first positioning structures 60.

Please refer to FIG. 2. The keyboard connecting mechanism 56 further includes a socket 68 installed inside the housing 52. The socket 68 includes a base 70. Two second positioning structures 72 are formed on a first side 701 of the base 70 and disposed on positions corresponding to the holes 66 on the cable 62 and the first positioning structures 60 on the frame 58. The second positioning structure 72 can be a protrusion for passing through the hole 66 on the cable 62 and inserting into the first positioning structure 60 on the frame 58 so as to fix the frame 58 and the cable 62 on the base 70 of the socket 68. The socket 68 further includes a plurality of fragments 74 disposed on the first side 701 of the base 70 to contact with the plurality of pins 64 and to apply elastic force to the plurality of pins 64 for good electrical connection. Two elastic structures 76 are disposed on both lateral sides of the base 70. The elastic structure 76 can be a hook, and an incline 761 is formed on a side of the elastic structure 76 facing to the frame 58. In addition, the socket 68 further includes a plurality of stitches 78 disposed on a second side 702 of the base 70 and electrically connected to the plurality of fragments 74 and internal circuit of the portable computer 50 so that signals can be transmitted between the keyboard 54 and a host of the portable computer 50 via electrical connection of the plurality of pins 64 on the cable 62, the plurality of fragments 74 on the first side 701 of the base 70, and the plurality of stitches 78 on the second side 702 of the base 70.

Figure 4:
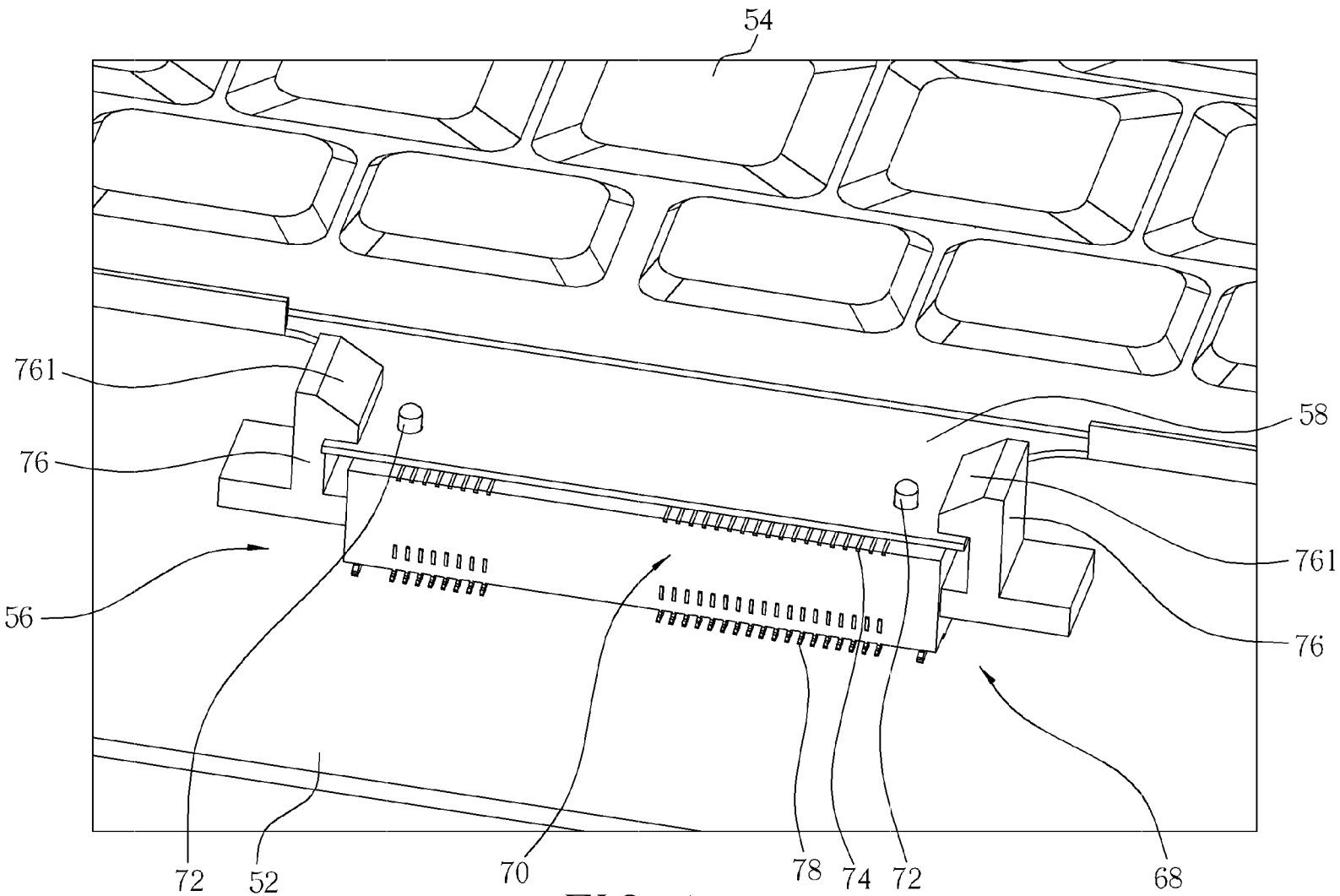
FIG. 4 is a schematic diagram of the frame assembled in a socket according to the preferred embodiment of the present invention.

Please refer to FIG. 4. FIG. 4 is a schematic diagram of the frame 58 assembled in the socket 68 according to the preferred embodiment of the present invention. First, a user can aim the frame 58 at the socket 68 and inserts the frame 58 into the socket 68 downward. At this time, the frame 58 pushes the elastic structures 76 outward. That is, the elastic structures 76 bend when being pressed down by the frame 58. The incline 761 of the elastic structures 76 can guide the frame 58 to smoothly slide downward. Then the first positioning structures 60 of the frame 58 and the holes 66 on the cable 62 sheathe with the second positioning structure 72 of the base 70. When the frame 58 is pressed to a right location, the elastic structures 76 recover to an original condition elastically and one end of each elastic structure 76 presses against the frame 58 so as to clamp the frame 58 and the cable 62 tightly. Furthermore, an elastic component can be disposed for connecting to the elastic structure 76 and a fixing end of the housing 52 for applying elastic force to the elastic structure 76 so as to assist the elastic structure 76 in pressing down the frame 58 and in recovering elastically. The elastic component can be a torsional spring. Besides, a magnetic component can be disposed on a first side 701 of the base 70 for attracting the frame 58 so as to fix the frame 58 on the first side 701 of the base 70. In conclusion, any mechanism for assisting the frame 58 in being fixed on the socket 68 is within the scope of the present invention.

The frame 58 and the cable 62 can be fixed on the housing 52 tightly by the pressing force of the elastic structure 76, the upward elastic force of the fragments 74 of the base 70, and the combination of the first positioning structures 60 of the frame 58, the holes 66 on the cable 62, and the second positioning structure 72 of the base 70. When the keyboard 54 is to be disassembled from the housing 52, the elastic structures 76 are pushed outward so as to release constraint on the frame 58 by the elastic structures 76.

The disposition and the number of the first positioning structures 60 and the second positioning structures 72 are not limited to the above-mentioned embodiment. In the above-mentioned embodiment, the first positioning structure 60 of the frame 58 is a hole, and the second positioning structure 72 of the base 70 is a protrusion accordingly. Similarly, the first positioning structure 60 of the frame 58 can be a protrusion, and the second positioning structure 72 of the base 70 can be a hole accordingly. The working principle is the same as the one of the above-mentioned embodiment, and hence detailed description is omitted hereby.

In contrast to the prior art, the present invention provides a keyboard connecting mechanism capable of assembling a keyboard easily and conveniently without utilizing screws. It can reduce difficulty, assembly hours, and assembly cost effectively.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyboard connecting mechanism comprising:

a frame connected to a keyboard, at least one first positioning structure being disposed on the frame;

a cable electrically connected to the keyboard and disposed on a side of the frame, the cable comprising a plurality of pins, and at least one hole being formed on the cable and disposed on a position corresponding to the first positioning structure; and a socket comprising:

a base, at least one second positioning structure being formed on a first side of the base and disposed on a position corresponding to the hole on the cable for connecting with the first positioning structure so as to fix the frame and the cable;

a plurality of fragments disposed on the first side of the base for applying elastic force to the plurality of pins; and at least one elastic structure disposed on a lateral side of the base for fixing the frame elastically.

2. The keyboard connecting mechanism of claim 1 wherein the cable is a flexible printed circuit.

3. The keyboard connecting mechanism of claim 1 wherein the first positioning structure is a hole.

4. The keyboard connecting mechanism of claim 3 wherein the second positioning structure is a protrusion for passing through the hole on the cable and inserting into the first positioning structure.

5. The keyboard connecting mechanism of claim 1 wherein the second positioning structure is a hole.

6. The keyboard connecting mechanism of claim 5 wherein the first positioning structure is a protrusion for passing through the hole on the cable and inserting into the second positioning structure.

7. The keyboard connecting mechanism of claim 1 wherein the elastic structure is a hook.

8. The keyboard connecting mechanism of claim 1 further comprising a plurality of stitches disposed on a second side of the base and electrically connected to the plurality of fragments.

9. The keyboard connecting mechanism of claim 1 further comprising an elastic component connected to the elastic structure for applying elastic force to the elastic structure.

10. The keyboard connecting mechanism of claim 1 wherein the frame is a metal plate.

11. The keyboard connecting mechanism of claim 10 further comprising a magnetic component disposed on the first side of the base for attracting the frame.

12. A portable computer comprising:

a housing;

a keyboard installed on the housing;

a frame connected to the keyboard, at least one first positioning structure being disposed on the frame;

a cable electrically connected to the keyboard and disposed on a side of the frame, the cable comprising a plurality of pins, and at least one hole being formed on the cable and disposed on a position corresponding to the first positioning structure; and a socket installed inside housing, the socket comprising:

a base, at least one second positioning structure being formed on a first side of the base and disposed on a position corresponding to the hole on the cable for connecting with the first positioning structure so as to fix the frame and the cable;

a plurality of fragments disposed on the first side of the base for applying elastic force to the plurality of pins; and at least one elastic structure disposed on a lateral side of the base for fixing the frame elastically.

13. The portable computer of claim 12 wherein the cable is a flexible printed circuit.

14. The portable computer of claim 12 wherein the first positioning structure is a hole.

15. The portable computer of claim 14 wherein the second positioning structure is a protrusion for passing through the hole on the cable and inserting into the first positioning structure.

16. The portable computer of claim 12 wherein the second positioning structure is a hole.

17. The portable computer of claim 16 wherein the first positioning structure is a protrusion for passing through the hole on the cable and inserting into the second positioning structure.

18. The portable computer of claim 12 wherein the elastic structure is a hook.

19. The portable computer of claim 12 further comprising a plurality of stitches disposed on a second side of the base and electrically connected to the plurality of fragments.

20. The portable computer of claim 12 further comprising an elastic component connected to the elastic structure for applying elastic force to the elastic structure.

21. The portable computer of claim 12 wherein the frame is a metal plate.

22. The portable computer of claim 21 further comprising a magnetic component disposed on the first side of the base for attracting the frame.

* * * * *